United States Patent [19]

Ono et al.

[11] Patent Number: 4,571,102

[45] Date of Patent: Feb. 18, 1986

[54] RIBBON MASK DEVICE

[75] Inventors: Toshiaki Ono; Yoshito Kusabuka, both of Suwa, Japan

[73] Assignees: Epson Corporation; Kabushiki Kaisha Suwa Seikosha, both of Tokyo, Japan

[21] Appl. No.: 658,854

[22] Filed: Oct. 9, 1984

[51] Int. Cl.[4] ..... B41J 35/04

[52] U.S. Cl. ..... 400/248; 400/124

[58] Field of Search ..... 400/124, 248, 248.1–248.3

[56] References Cited

U.S. PATENT DOCUMENTS 4,165,188 8/1979 Rempel ..... 400/248 X 4,383,775 5/1983 Trammell et al. ..... 400/248 X

FOREIGN PATENT DOCUMENTS 31789 2/1983 Japan ..... 400/248

*Primary Examiner*—Paul T. Sewell

*Attorney, Agent, or Firm*—Blum, Kaplan, Friedman, Silberman & Beran

[57] ABSTRACT

A printing device for use in a wire dot printer having a plurality of printing wires. The printing device includes a frame and a carriage slideably supported on the frame for lateral translation thereacross. A print head is supported on the carriage and includes a nose portion which supports the plurality of printing wires. First and second holders are disposed on the carriage so that the nose portion is intermediate the first and second holders. A ribbon mask constructed from a resilient material is disposed on the nose portion. The ribbon mask is held in position by engagement with the first and second holders. The carriage includes a projection extending towards the ribbon mask. The ribbon mask is further supported by the projection. In addition, the ribbon mask may include a plurality of projections which extend towards and abut against the nose portion to keep the surface of the ribbon mask spaced from the nose portion to permit travel of an ink ribbon therebetween.

12 Claims, 7 Drawing Figures

RIBBON MASK DEVICE

BACKGROUND OF THE INVENTION

The present invention is directed generally to a ribbon mask device, and in particular to a ribbon mask disposed between the tip end of a wire dot-matrix print head in a serial printer and a platen for separating a sheet of print paper from an ink ribbon in the printer.

FIGS. 5, 6 and 7 of the drawings depict a ribbon mask such as that disclosed in co-pending U.S. patent application Ser. No. 407,859, filed Aug. 13, 1982, now U.S. Pat. No. 4,492,484 and assigned to the same assignees as the present application. In a serial printer having a wire dot-matrix print head 21, a thin ribbon mask 26 is disposed in a small clearance (hereinafter referred to as a "platen gap") between a tip end 21-2 of print head 21 and a platen 24 for separating a sheet of print paper 27 and an ink ribbon 28 to thereby prevent problems which would occur due to contact therebetween. The platen gap, which is set to be constant, is highly important for sufficient performance of the print head and for achieving good printing quality.

To meet these requirements, the print head is assembled so that print wires 23, as they are in a standby position, will lie flush with tip end 21-2 of print head 21, and thereafter tip end 21-2 and print wires 23 are simultaneously ground to provide the platen gap, indicated at E. One method which has been widely employed in the art to achieve the desired platen gap has been to assemble and adjust the parts while a thickness gauge is placed between tip end 21-2 and platen 24 before ribbon mask 26 is assembled in place.

The position where ribbon mask 26 is situated in platen gap E more or less affects the performance of travel of the print paper and the ink ribbon. In order to allow ink ribbon 28 to run stably between tip end 21-2 and ribbon mask 26, print head 21 has on its tip end 21-2 small projections 21-3 and 21-4 which are slightly higher than the thickness of the ink ribbon to thereby provide a clearance or gap F. A gap G is also provided to permit print paper 27 to travel stably, and is automatically maintained by platen gap E, gap F, and the thickness of ribbon mask 26. Gaps F and G, as well as platen gap E, play quite important roles in the printing device.

Because of the small projections 21-3 and 21-4 on the tip end of the print head as disclosed in application serial no. 407,859, however, a grinding stone, as it grinds the tip end 21-2 of the print head, tends to have a fixed area with which the tip end 21-2 is ground, and hence becomes locally worn. Therefore, the grinding stone has to be shaped to contour many times. In addition, a thickness gauge cannot easily be placed in position upon adjustment of the platen gap.

Ribbon mask 26 has an opening 26-5 for allowing print wires 23 to press ink ribbon 28 against print paper 27. If ribbon mask 26 is displaced in the directions of arrows 32 or 33, then print wires 23 will hit ink ribbon 28 at the edges of opening 26-5, resulting in a reduced printing capability of print head 21. As a consequence, printed characters on other marks will become light in color, or sometimes wires 23 will hit ribbon mask 26, failing to effect printing.

Since ribbon mask 26 is displaced in the direction of arrow 34 when attaching and removing ink ribbon 28, there is a clearance or gap H provided between each of hooked portions 26-3 and 26-4 of ribbon mask 26 and a corresponding one of holders 25. Therefore, ribbon mask 26 is liable to be displaced in the direction of arrow 32, with the result that printed characters or marks will be light in color or no printing can be effected at certain times. Furthermore, when ink ribbon 28 is damaged due to prolonged use and catches ribbon mask 26, ribbon mask 26 is likely to disengage from holders 25 since the hooked portions 26-3 and 26-4 are small, and hence will be deformed. Accordingly, an improved ribbon mask which overcomes the above-noted problems, is desired.

SUMMARY OF THE INVENTION

Generally speaking, in accordance with the present invention, a printing device for use in a wire dot printer having a plurality of printing wires, is provided. The printing device includes a frame and a carriage slideably supported on the frame for lateral translation thereacross. A print head is supported on the carriage and includes a nose portion for holding the plurality of wires. First and second holders are disposed on the carriage so that the nose portion is intermediate the first and second holders. A ribbon mask constructed from a resilient material is disposed on the nose portion. The ribbon mask is held in position by engagement with the first and second holders. The carriage includes a projection extending towards the ribbon mask. The ribbon mask is further supported on the nose portion by the projection.

In addition, the ribbon mask may include a plurality of projections extending towards and abutting against the nose portion to keep the surface of the ribbon mask spaced from the nose portion.

This construction permits proper paper feed and ink ribbon transport without interference. The platen gap remains fixed and free from interference.

Accordingly, it is an object of the present invention to provide an improved ribbon mask device for a wire dot printer.

Another object of the present invention is to provide an improved ribbon mask which overcomes the difficulties encountered in the prior art.

Yet another object of the present invention is to provide a serial printer having a ribbon mask disposed on the print head which insures positive paper feed and ink ribbon transport.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
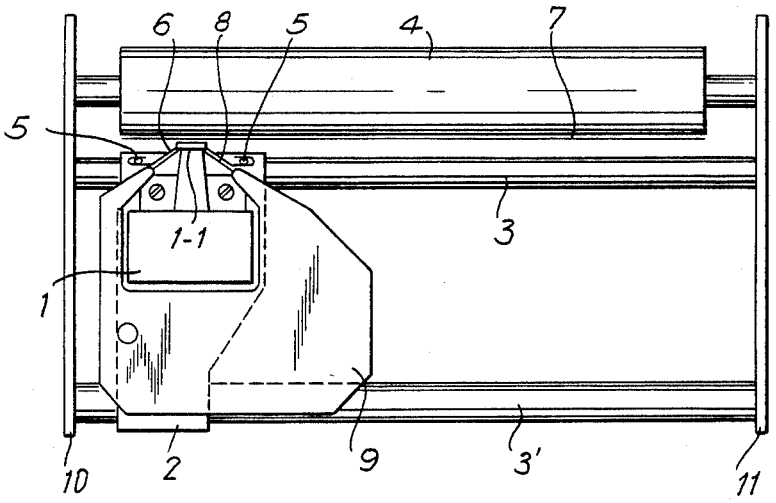
FIG. 1 is a top plan schematic view of a serial printer having a ribbon mask device constructed in accordance with the present invention.

Reference is first made to FIG. 1 which depicts a serial printer in accordance with a preferred embodiment of the present invention. A carriage 2 supports a print head 1 and a ribbon cartridge 9 and is driven by a drive mechanism (not shown) to reciprocate laterally in front of a platen 4. Carriage 2 is guided by guide shafts 3 and 3'. A sheet of print paper is shown at 7. A ribbon mask 6 is made of thin, resilient material such as a stainless steel sheet, and extends between two holders 5 in the form of straight posts mounted on carriage 2 and a nose end face 1-1 of print head 1. Ribbon cartridge 9 accommodates an ink ribbon 8 therein. The printer has lateral frames 10 and 11 supporting platen 4 and guide shafts 3 and 3' therebetween.

Figure 2:
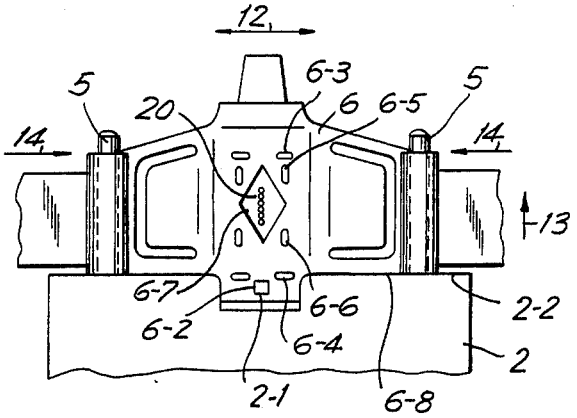
FIG. 2 is a front elevational view of the print head and ribbon mask depicted in FIG. 1, constructed in accordance with a preferred embodiment of the present invention.
Figure 3:
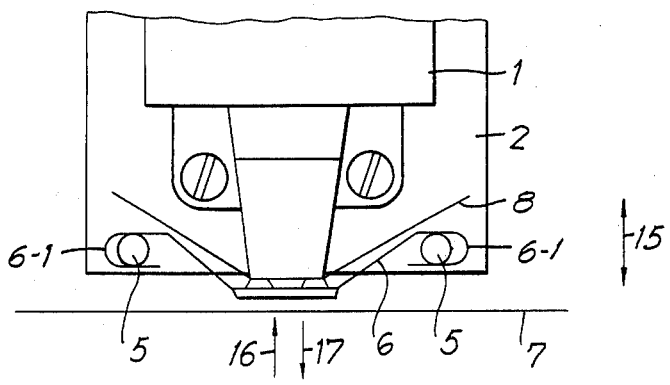
FIG. 3 is a top plan view of the print head and ribbon mask depicted in FIG. 2.
Figure 4:
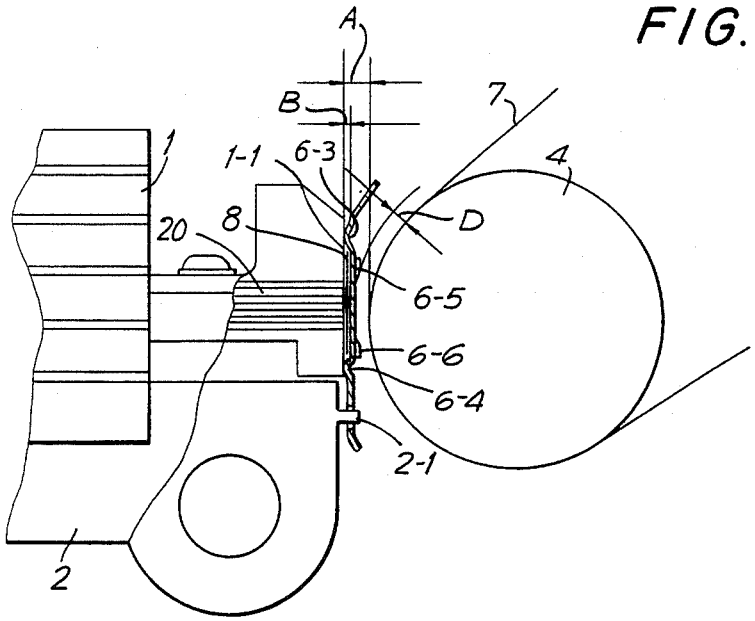
FIG. 4 is a side sectional view of the print head and ribbon mask depicted in FIG. 2.

Reference is now made to FIGS. 2 through 4. A plurality of print wires 20 are arranged in a row on nose end face 1-1 of print head 1 and project toward platen 4. When in a standby position, print wires 20 lie essentially flush with nose end face 1-1 with a clearance or gap A maintained between print wires 20 and platen 4. Nose end face 1-1 is composed of a flat surface with no projections thereon.

Ribbon mask 6, which is made of thin, elastic material, has opposite hook-shaped ends 6-1 which engage holders 5 in surrounding relation for preventing hooked portions 6-1 from being displaced in the direction of arrow 15. Ribbon mask 6 has an opening 6-2, which may be rectangular, round or other such shape, in which a projection 2-1 on carriage 2 engages to prevent ribbon mask 6 from being displaced in the directions of arrows 12 or 13. A lower edge 6-8 of ribbon mask 6 abuts against an upper surface 2-2 of carriage 2 to prevent ribbon mask 6 from being turned about projection 2-1. Ribbon mask 6 also has a plurality of small prjections 6-3 and 6-4 of height B on a surface facing print head 1. Projections 6-3 and 6-4 are pressed against nose end face 1-1 under the resiliency of ribbon mask 6 itself. Ribbon mask 6 also has a plurality of projections 6-5 and 6-6 on a surface facing platen 4 for preventing print paper 7 from being caught by edges of an opening 6-7 defined in ribbon mask 6 to allow the print wires 20 to pass therethrough.

A gap A is of small dimension ranging from 0.4 to 0.5 mm determined for good printing quality in view of various print head performances such as printing speed, copying ability, durability, noise, and other factors.

A gap B is automatically maintained by the small projections 6-3 and 6-4 of ribbon mask 6, and has a dimension equal to the thickness of the ink ribbon 8 plus about 0.05 mm for allowing the ink ribbon 8 to travel stably in the direction of arrow 12.

A gap D serves as a passage for print paper 7. Provided ribbon mask 6 has a thickness C, then $$D=A-B-C$$

and the gap D is automatically established by mounting ribbon mask 6. If A=0.5 mm, C=0.1 mm, and the ink ribbon thickness D is about 0.1 mm, then B=0.1+0.05, and D=0.5−0.15−0.1=0.25 mm.

The gap thus determined allows three to four sheets of copying print paper to be inserted therein and run smoothly without being subjected to any resistance, so that the sheets can be fed well. Accordingly, it is quite easy to establish the gaps required for obtaining the basic performance of the print head and to space print paper 7 and ink ribbon 8 from each other with ribbon mask 6 held stably in a position to maintain the gap required for print paper 7 and ink ribbon 8 to run stably.

Ribbon mask 6, which is elastic, itself can easily be mounted and dismounted by pushing the ends 6-1 of the ribbon mask 6 in the directions of arrows 14 to flex ribbon mask 6 in the direction of arrow 17 until opening 6-2 is brought out of engagement with projection 2-1 on carriage 2, and then by pulling ribbon mask 6 upwardly.

With the arrangement of the invention, as described above, small projections 6-3 and 6-4 for maintaining the gap B are provided on the ribbon mask 6, and nose end face 1-1 is flat with no projection, so that a grinding stone, as it grinds the nose end face, will be uniformly worn. Therefore, the grinding stone may be shaped to contour a greatly reduced number of times. Since there is no projection on the nose end face, a thickness gauge can easily be inserted for adjusting the platen gap with greater accuracy and efficiency.

Furthermore, projection 2-1 on carriage 2 engages in opening 6-2 in ribbon mask 6 to prevent ribbon mask 6 from being displaced in the directions of arrows 12 and 13, with the result that printing quality is rendered stable.

Figure 5:
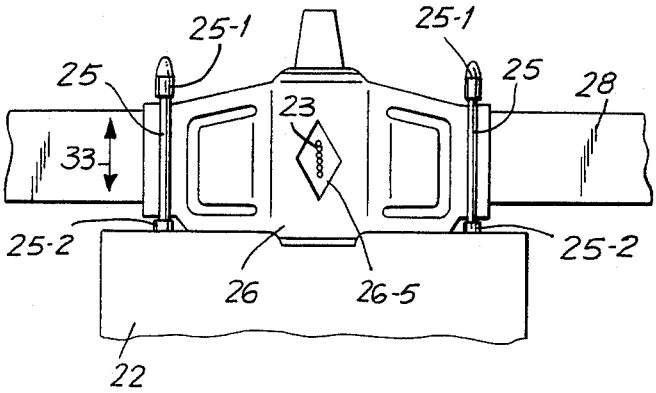
FIG. 5 is a front elevational view of a print head and ribbon mask constructed in accordance with co-pending application no. 06/407,859, filed Aug. 13, 1982.
Figure 6:
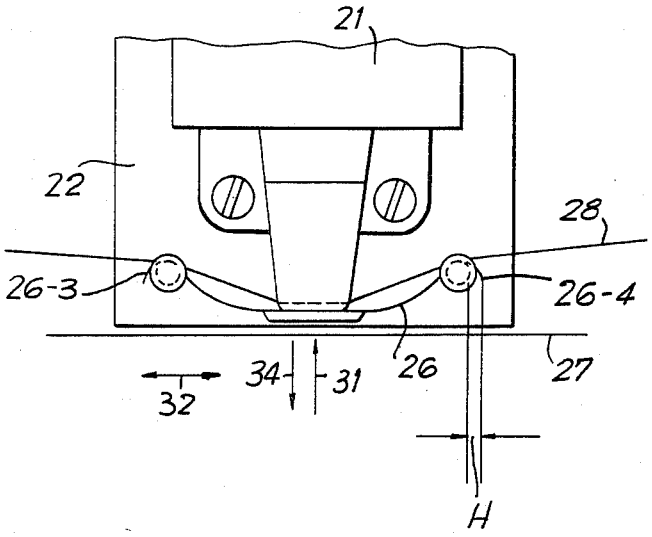
FIG. 6 is a top plan view of the print head and ribbon mask depicted in FIG. 5.
Figure 7:
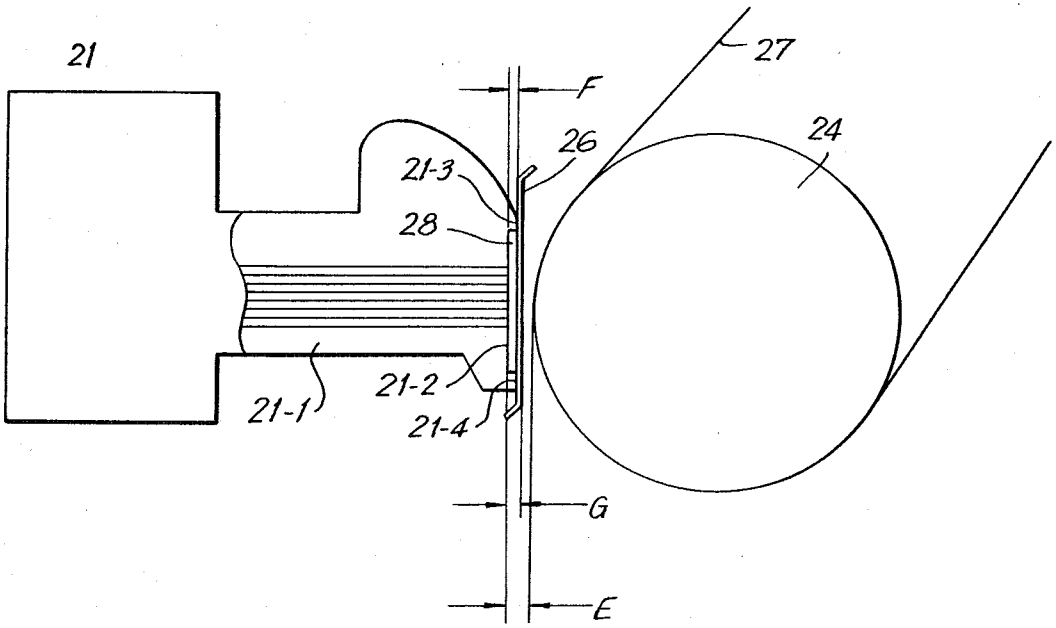
FIG. 7 is a side sectional view of the print head and ribbon mask depicted in FIG. 5.

Heretofore, the ribbon mask has been prevented from being displaced by steps or enlarged heads 25-1 and 25-2 of holders 25 as depicted in FIG. 5. According to the invention, however, holders 5 may comprise straight posts, and can be manufactured less costly.

Since opposite ends 6-1 of ribbon mask 6 are of a hook shape in surrounding relation to holders 5, ends 6-1 and holders 5 will not be brought out of engagement with each other, and therefore ribbon mask 6 will not be deformed.

It will thus be seen that the objects set forth above, among those made apparent from the preceding description, are efficiently attained and, since certain changes may be made in the above construction without departing from the spirit and scope of the invention, it is intended that a 11 matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing device for use in a wire dot printer having a plurality of printing wires comprising a frame, carriage means slideably supported on said frame for lateral translation thereacross, print head means supported on said carriage means having a nose portion for holding said plurality of wires, first and second holder means disposed on said carriage means so that said nose portion is intermediate said first and second holder means, and a ribbon mask constructed from a resilient material and disposed on said nose portion, said ribbon mask being held in position to extend laterally across said nose portion by engagement with said first and second holder means, said carriage means having a projection extending toward said ribbon mask, said ribbon mask including an opening in which said projection is removably captured to substantially prevent longitudinal movement of said ribbon mask with respect to said nose portion while said projection extends through said opening, said projection and opening being sized to permit manual movement of said ribbon mask away from said nose portion to release said projection from said opening.

2. The printing device as claimed in claim 1, wherein said ribbon mask includes a plurality of projections extending from a surface of said ribbon mask towards and abutting against said nose portion to keep the surface of said ribbon mask spaced from said nose portion to permit travel of an ink ribbon therebetween, said projections being out of the path of travel of said ink ribbon so as not to interfere with movement thereof.

3. The printing device as claimed in claim 1, wherein said ribbon mask includes a lower end, said lower end of said ribbon mask abutting against said carriage means to prevent said ribbon mask from moving about said projection on said carriage means when said projection extends into said opening.

4. The printing device as claimed in claim 2, wherein said ribbon mask includes a lower end, the lower end of said ribbon mask abutting against said carriage means to prevent said ribbon mask from moving about said projection on said carriage means when said projection extends into said opening.

5. The printing device as claimed in claim 1, wherein said ribbon mask includes a second set of projections which extend from a surface of said ribbon mask away from said print head to keep a print paper spaced from the surface of said ribbon mask.

6. The printing device as claimed in claim 2, wherein said ribbon mask includes a second set of projections extending from a surface of said ribbon mask away from said print head to prevent a print paper from coming in contact with the surface of said ribbon mask.

7. The printing device as claimed in claim 6, wherein said ribbon mask includes a second set of projections which extend from a surface of said ribbon mask away from said print head to prevent a print paper from contacting the surface of said ribbon mask.

8. The printing device as claimed in claim 1, wherein said first and second holder means are straight posts, said ribbon mask having opposing hook-shaped ends which respectively engage said first and second holder means.

9. The printing device as claimed in claim 2, wherein said first and second holder means are straight posts, said ribbon mask having opposing hook-shaped ends which respectively engage said first and second holder means.

10. A printing device for use in a wire dot printer having a plurality of printing wires, comprising a frame, carriage means slideably supported on said frame for lateral translation thereacross, print head means supported on said carriage means having a nose portion for holding said plurality of said wires, first and second holder means disposed on said carriage means so that said nose portion is intermediate said first and second holder means, and a ribbon mask constructed from a resilient material and disposed on said nose portion, said ribbon mask having a plurality of projections which extend from a surface of said ribbon mask towards and abut against said nose portion to keep the surface of said ribbon mask spaced from said nose portion to permit travel of an ink ribbon therebetween, said projections being out of the path of travel of said ink ribbon so as not to interfere with movement thereof.

11. The printing device as claimed in claim 10, wherein said ribbon mask includes a second set of projections which extend from a surface of said ribbon mask away from said print head to prevent a print paper from coming into contact with the surface of said ribbon mask.

12. The printing device as claimed in claim 11, wherein said first and second holder means are straight posts, said ribbon mask having opposing hook-shaped ends which respectively engage said first and second holder means.

* * * * *